United States Patent [19]

Crimella

[11] 4,118,815

[45] Oct. 10, 1978

[54] AUTOMATIC TOE FORMING MACHINE FOR SHOES, IN PARTICULAR DANCING AND GYMNASTICS SHOES

[76] Inventor: Renato Crimella, Viale Famagosta, 28 - Milan, Italy

[21] Appl. No.: 795,373

[22] Filed: May 9, 1977

[30] Foreign Application Priority Data

Jun. 25, 1976 [IT] Italy ..... 24785A/76

[51] Int. Cl.[2] ..... A43D 15/00

[52] U.S. Cl. ..... 12/7.9

[58] Field of Search ..... 12/1 R, 7.9, 7

[56] References Cited

U.S. PATENT DOCUMENTS

| | | | |
|---|---|---|---|
| 2,455,106 | 11/1948 | Wirtz | 12/7 |
| 3,474,475 | 10/1969 | Fisk | 12/7.9 |

*Primary Examiner*—Patrick D. Lawson

*Attorney, Agent, or Firm*—Stevens, Davis, Miller & Mosher

[57] ABSTRACT

This invention relates to an automatic toe forming machine for shoes, in particular shoes designed for dancers and gymnasts. The machine according to the invention comprises a last holding assembly, a first assembly of mechanical fingers movable to a working position in which they rest against the toe of a shoe last contained in said last holding assembly, and a second assembly of mechanical fingers movable to a working position in which they are disposed between the fingers of the first assembly so as to make the vamp covering the last assembly a pattern in the form of folds, its path passing under the fingers of one assembly and over the fingers of the other.

11 Claims, 16 Drawing Figures

AUTOMATIC TOE FORMING MACHINE FOR SHOES, IN PARTICULAR DANCING AND GYMNASTICS SHOES

This invention relates to an automatic toe forming machine for shoes, in particular shoes designed for dancers and gymnasts.

As is well known to experts of this particular art, this type of shoe comprises a soft toe formed from a vamp portion projecting from the sole to which the vamp is fixed.

This enables the user to stand directly on the floor with his toes, particularly in those dancing figures which are executed on tip toe.

Such shoes have been manufactured manually up to the present time by artesans who, although highly specialised, are able to produce only a limited number of shoes, this number not completely satisfying present requirements.

More precisely, these shoes are manufactured by fixing their sole to a shoe last with the tread facing outwards, the sole being in a central position such that the toe of the last projects a certain distance beyond the toe of the sole.

The last on which the sole is mounted is then covered with a piece of vamp, and the entire assembly is disposed in a last support with the visible part of the sole facing upwards and the vamp flaps extending upwards for folding over the last and fixing to the sole. The vamp covering the last has its inside facing outwards.

The vamp must be fixed to the toe of the sole in such a manner that the toe of the finished shoe has a plan profile which is substantially semicircular, and the part between the end of the sole and the end of the vamp is configured such as to allow secure and continuous support on the floor without any disturbing uneveness.

To this end, the artesan manually models the vamp into a toe by a series of radial folds and then holds it and fixes it by adhesive to the toe of the sole. After gluing the rest of the vamp to the sole, this latter is removed from the last and is fed to the subsequent operations such as possibly lining the vamp, trimming and sewing the vamp and then turning the entire practically finished shoe the right way round.

Of the aforesaid operations, that which requires the greatest ability, time and labour by the operator is the folding of the vamp into a toe, because often the new vamp is relatively rigid.

The object of the present invention is to mechanise this operation.

This object is attained according to the present invention by an automatic toe forming machine for shoes, in particular dancing and gymnastics shoes, comprising, in combination, a last holding assembly, a first assembly of mechanical fingers movable between a non-working position and a working position in which they rest against the toe of a shoe last contained in said last holding assembly, and a second assembly of mechanical fingers also movable between a non-working position and a working position in which they are disposed between the fingers of the first assembly so as to make the vamp covering the last assume a pattern in the form of folds, its path passing under the fingers of one assembly and over the fingers of the other.

The structural and operational characteristics of the invention and its advantages will be more evident from the description given hereinafter of one embodiment with reference to the accompanying drawings, in which.

Figure 1:
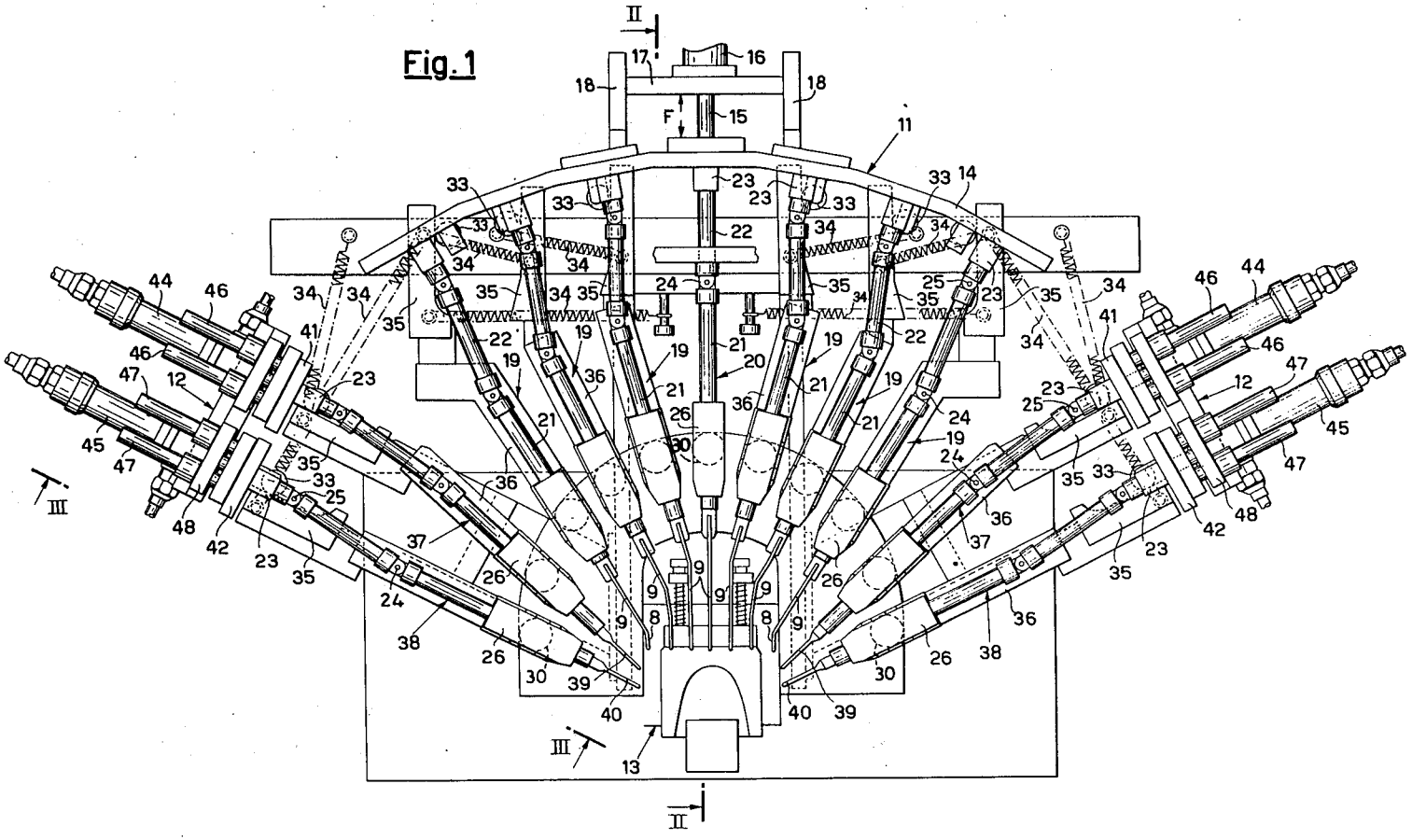
FIG. 1 is a plan view of a machine according to the invention.
Figure 2:
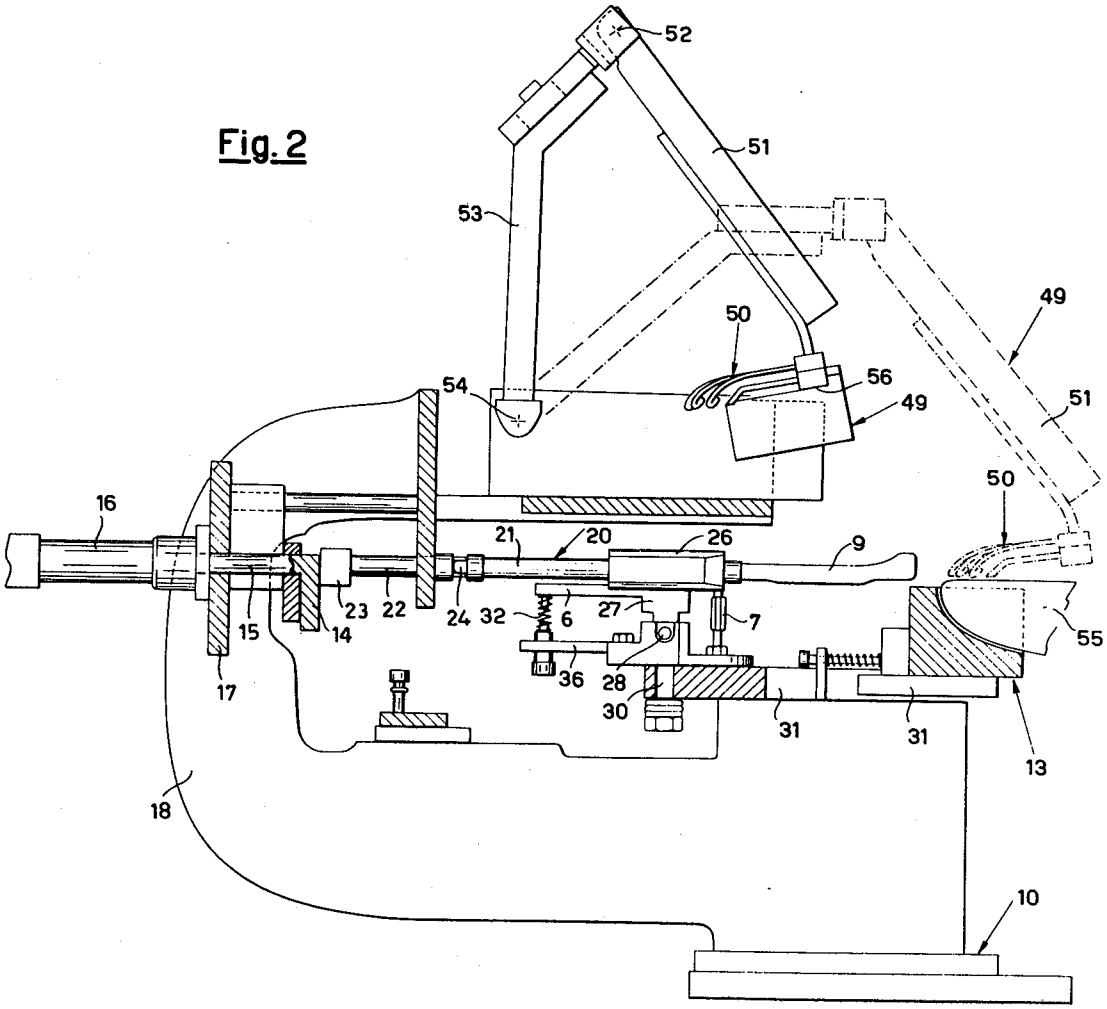
FIG. 2 is a section on the plane II—II of FIG. 1.
Figure 3:
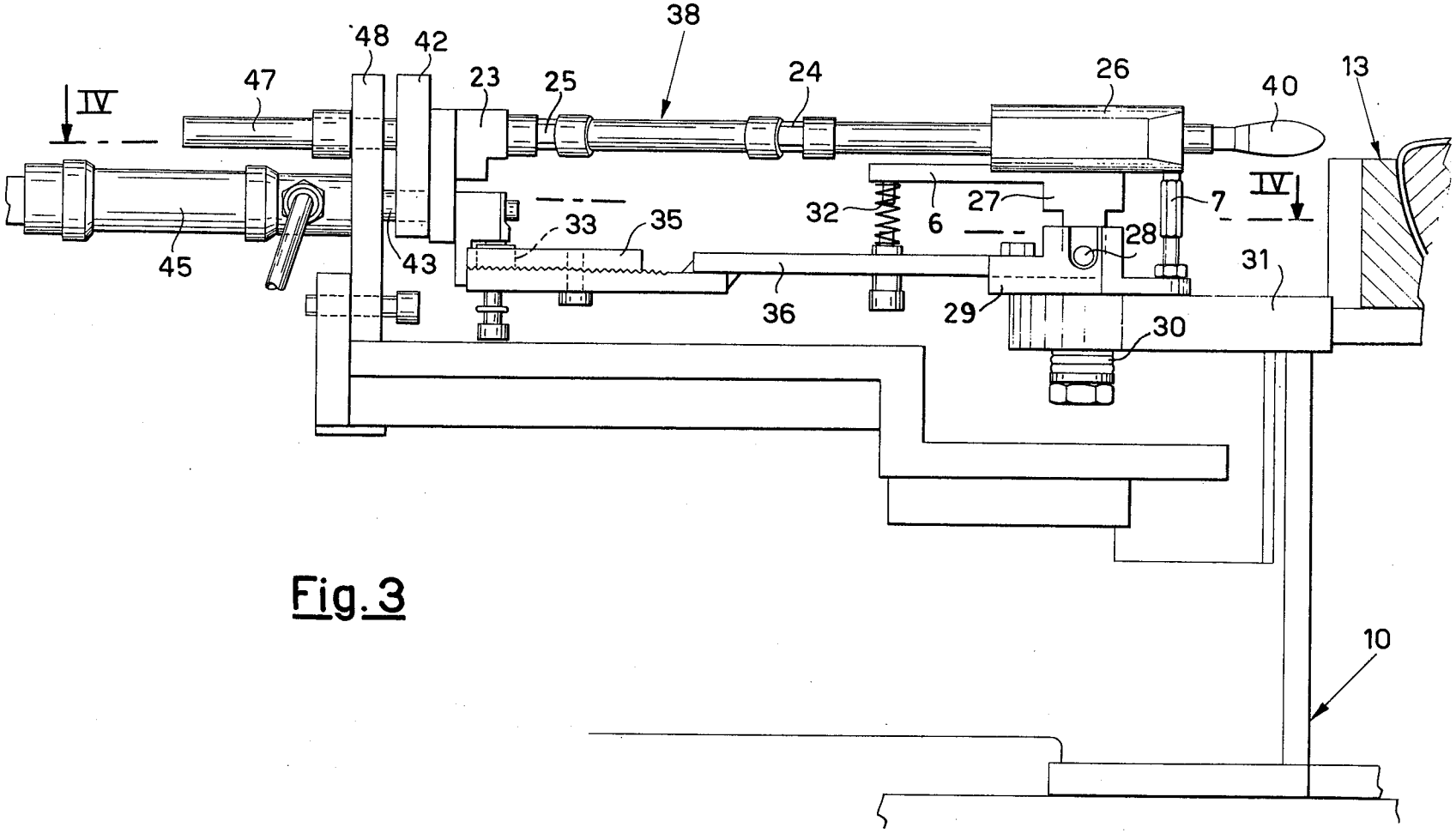
FIG. 3 is an elevation in the direction of the arrows III—III of FIG. 1.
Figure 4:
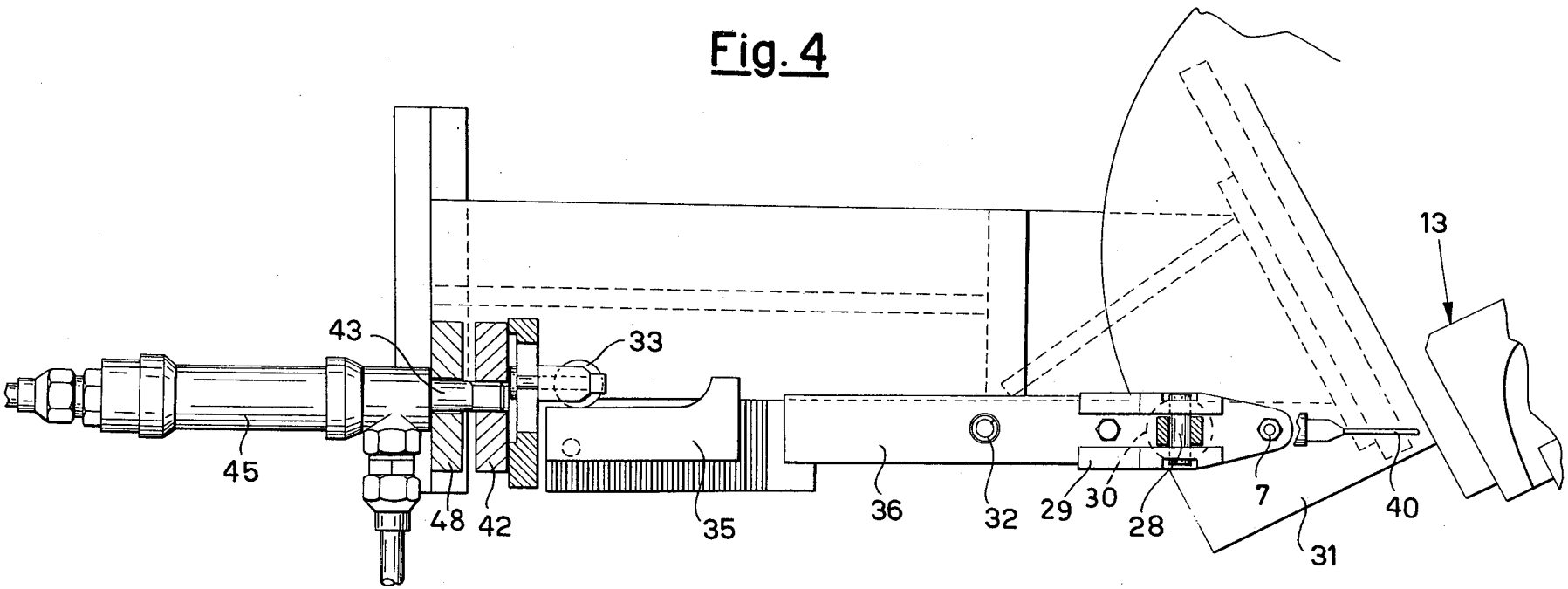
FIG. 4 is a section on the plane IV—IV of FIG. 3.
Figure 5:
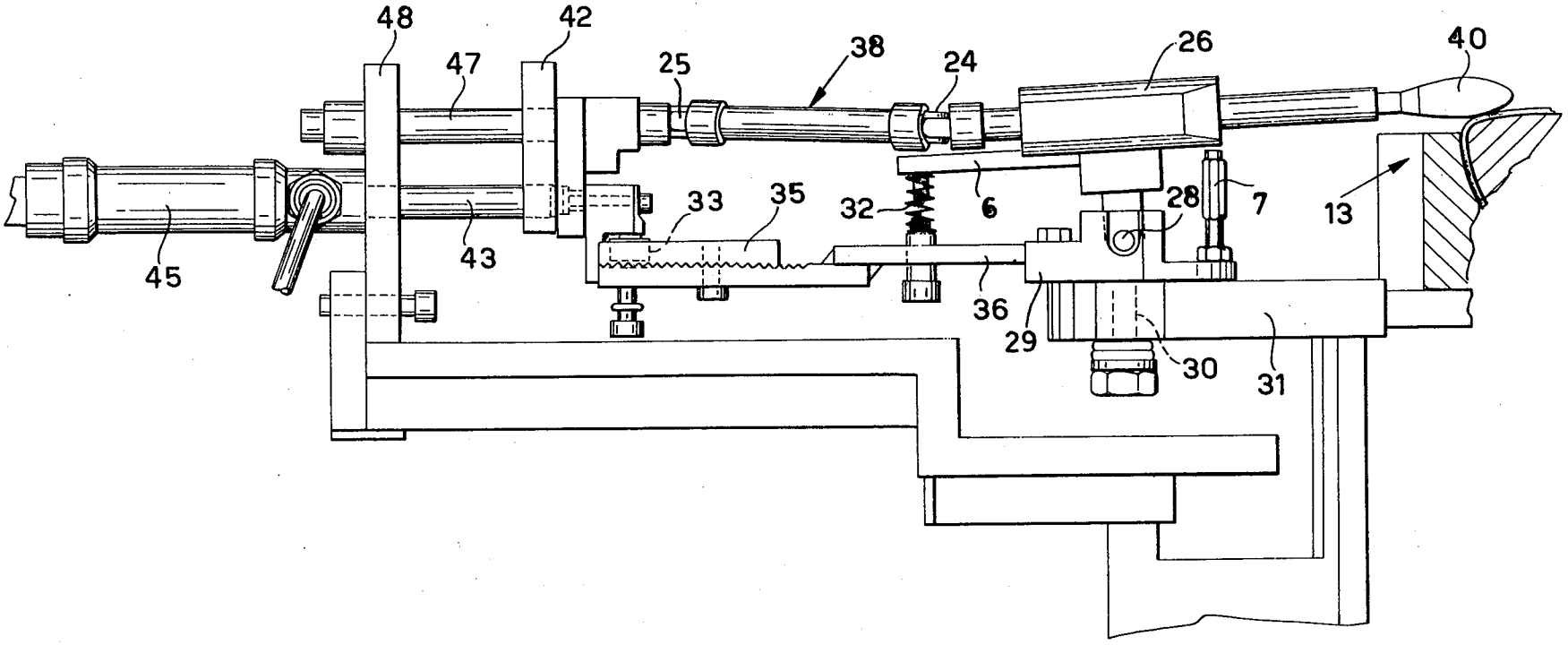
FIG. 5 is a view as in FIG. 3, but illustrating the components in a different working position.
Figure 6:
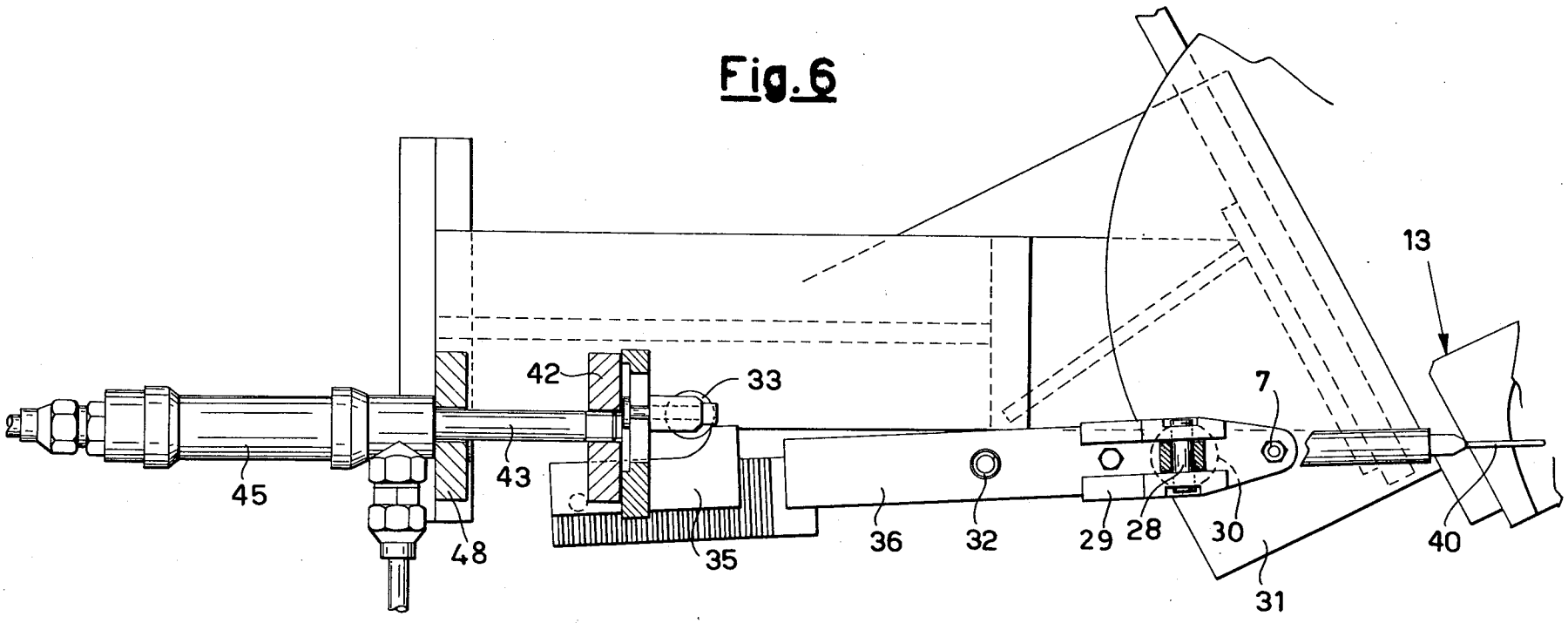
FIG. 6 is a view as in FIG. 4, but illustrating the components in a different working position.
Figure 7:
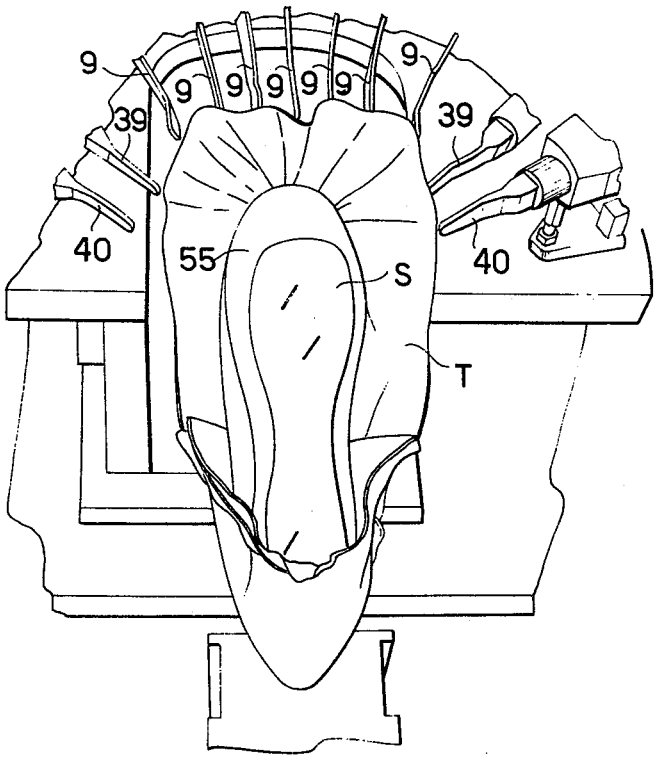
FIGS. 7 to 15 show the different working stages of the machine according to the invention.

With reference to FIGS. 1, 2 and 3 of the drawings, the machine according to the invention consists structurally of a load-bearing frame 10 on which three mobile working assemblies are mounted radially, namely an intermediate assembly 11 and two lateral assemblies 12, specularly analogous, and a central stationary last holding assembly 13 towards which the mobile assemblies 11 and 12 converge.

The assembly 11 comprises a curved support plate 14 fixed to the piston rod 15 of a hydraulic cylinder 16, by which the plate 14 may be moved backwards and forwards in the directions indicated by the arrows F in FIG. 1. The jack 16 is mounted on a plate 17 fixed transversely to the shoulders 18 of the frame 10.

As is evident from FIG. 1 of the drawings, to the plate 14 there are connected a plurality of mechanical fingers, namely six in the example shown, and for clarity of description these are divided into two groups of three lateral fingers 19 and a central finger 20.

Each mechanical finger 19 comprises two rods 21, 22 hinged together and to a block 23 fixed to the plate 14, by respective universal joints 24, 25. The rod 19 is guided in a sleeve 26 which is pivoted at 28, via a fork 27 rigid therewith, to a base 29 pivoted in its turn at 30 to a bracket 31 fixed to the frame 10.

The last holding assembly 13 is also fixed to the bracket 31.

It is apparent that the pivoting arrangements 28, 30 enable the sleeve 26 and thus the mechanical fingers to rotate in vertical and horizontal planes normal to each other.

A compression spring 32 urges the sleeve 26 to rotate clockwise about 28 against a limit setting stop 7. The spring 32 acts between an arm 36 rigid with the base 29 and an extension 6 of the fork 27.

Each mechanical finger 19 carries at the block 23 an idle cam following roller 33 kept by springs 34 in working contact with the active contour of a directional cam 35 fixed to the arm 36.

The mechanical fingers 19 each comprise a blade 9 at that end of the rod 21 emerging from the sleeve 26. As is evident in FIG. 1, the blades 9 have their ends 8 bent for the purpose which will be described hereinafter.

The central mechanical finger 20 has a structure substantially identical with that of the finger 19 just described. The only differences are that the rod 22 is directly connected to the block 23 without disposing the universal joint 25 therebetween, the blade 9 is straight, and no directional cam acts on the finger. In fact, it moves along a straight line.

Each lateral assembly 12 comprises a pair of mechanical fingers 37, 38 structurally identical to 19, for which reason the components thereof are indicated on the drawings by the same reference numerals.

The only difference is that the fingers 37, 38 terminate in respective blades 39, 40 which are not parallel and are instead directed radially towards the central last holding assembly 13.

The fingers 37, 38 are carried by respective plates 41, 42 connected to the piston rod 43 of respective hydraulic control cylinders 44, 45. The fingers 37, 38 can thus move backwards and forwards, and their support plates 41, 42 are guided for this purpose by pairs of guides 46, 47 passing through the support 48 fixed to the frame, and on which the cylinders 44, 45 are mounted.

With reference to FIG. 2, a third mobile working assembly indicated overall by 49 cooperates with the assemblies 11, 12 and 13.

This assembly 49 comprises a further complex of six mechanical fingers 50 arranged for insertion between the blades 9 of the mechanical fingers 19.

The fingers 50 are fixed to a first arm 51 pivoted at 52 to a second angle arm 53, pivoted in its turn at 54 to the machine frame. The fingers 50 are thus movable between the raised non-working position indicated by the continuous line in FIG. 2, and the lowered working position resting on a last 55, indicated by a dashed and dotted line.

Retention means 56 are also provided for maintaining the fingers 50 securely in the non-working raised position.

The operation of the machine according to the invention is described hereinafter, with particular reference to FIGS. 7 to 16.

At the beginning of each working cycle, all the mechanical fingers of the assemblies 11, 12 are withdrawn and the fingers of the assembly 49 (FIG. 2) are in the raised position.

The operator places the last 55, with the shoe sole S attached, in the last holding assembly 13, and wraps the last 55 in the vamp T, the marginal edges of which extend upwards.

Figure 8:
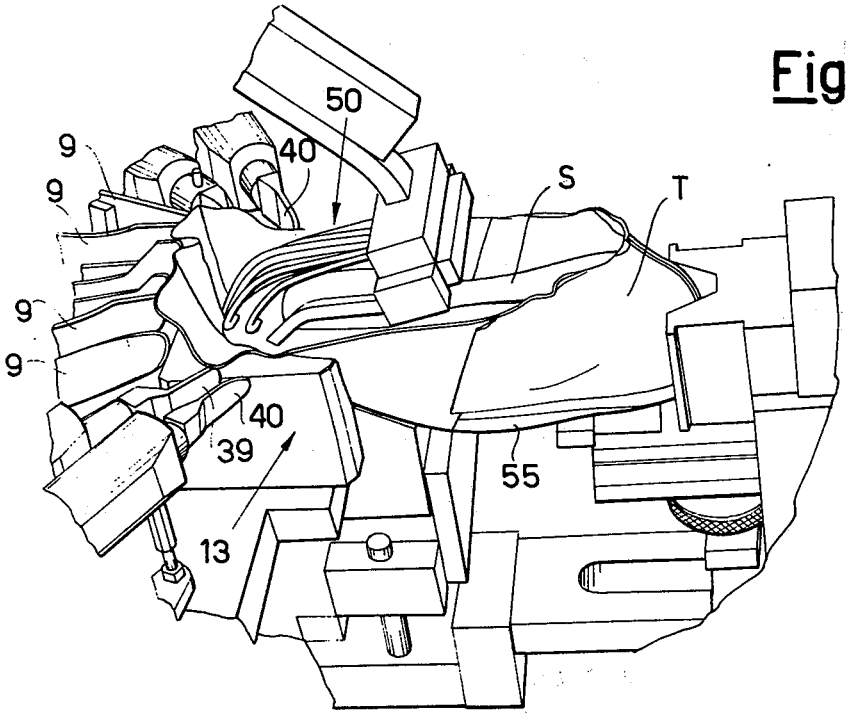

The assembly 49 is lowered manually to bring its fingers 50 on to the last 55 in the position shown by a dashed and dotted line in FIG. 2 and by a continuous line in FIG. 8.

Figure 9:
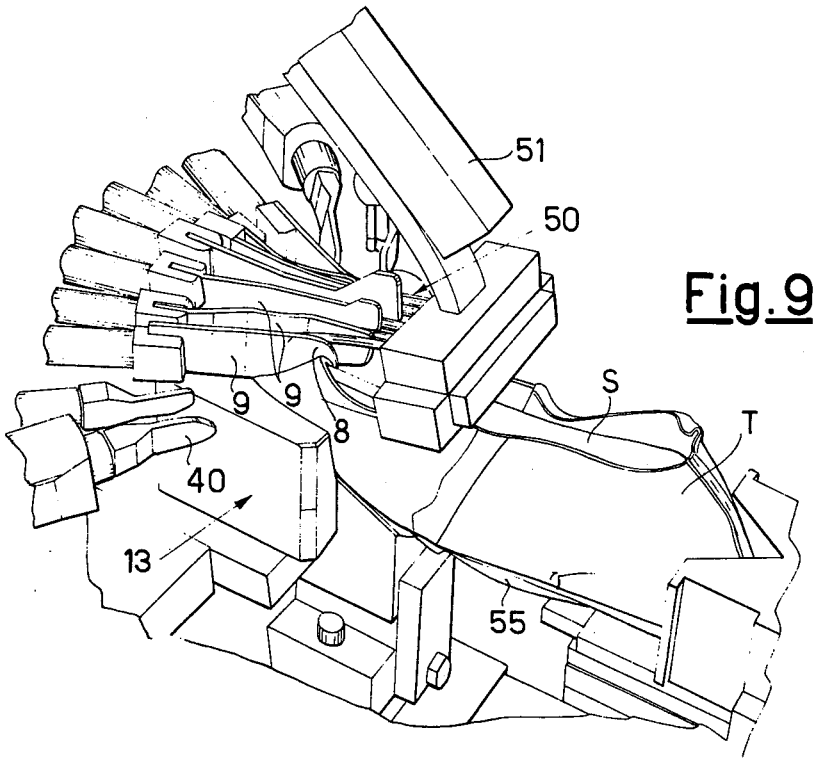

At this point the mechanical fingers 19 of the central assembly 11 are moved forward into the position of FIG. 9, between the fingers 50 of the assembly 49. This is possible by the action of the cams 35 which cause the rods 21, 22 to swivel about the pivots 30 such that the portions 8 of the blades 9 move forward parallel to each other and to the central blade 9. As a consequence of this forward movement, the vamp T is folded on the last and induced to take up the folded position indicated in FIG. 16, i.e. to pass under the blades and above the fingers. In this respect it should be noted that the last is located at a slightly higher level than the mechanical fingers 19, which are thus made to swivel in an anticlockwise direction about 28 against the action of the springs 32. This ensures correct tension in the vamp T.

Figure 10:
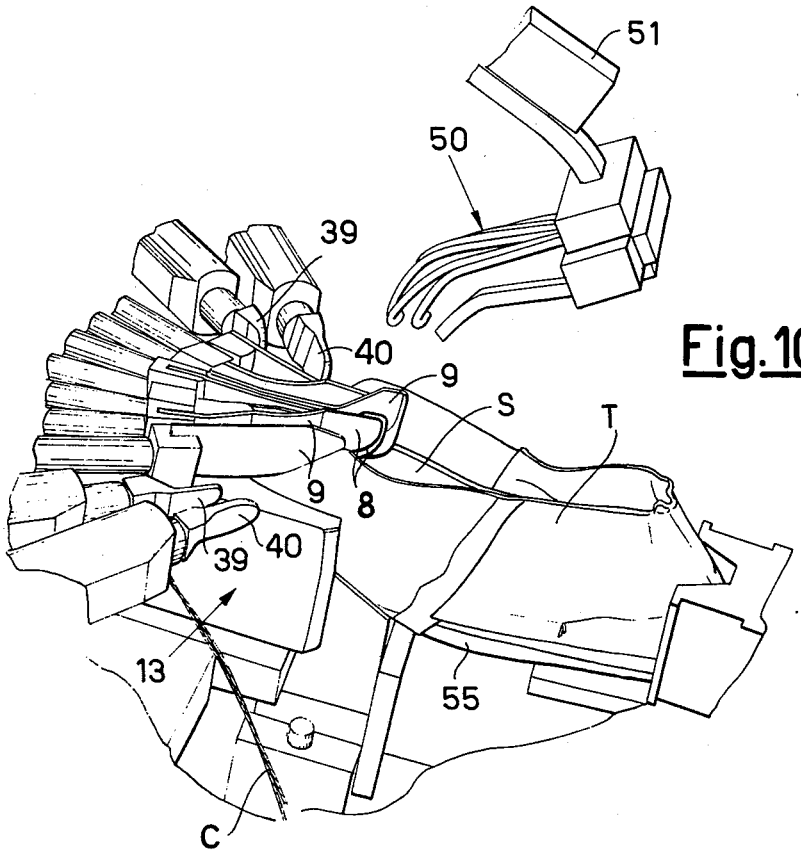
Figure 11:
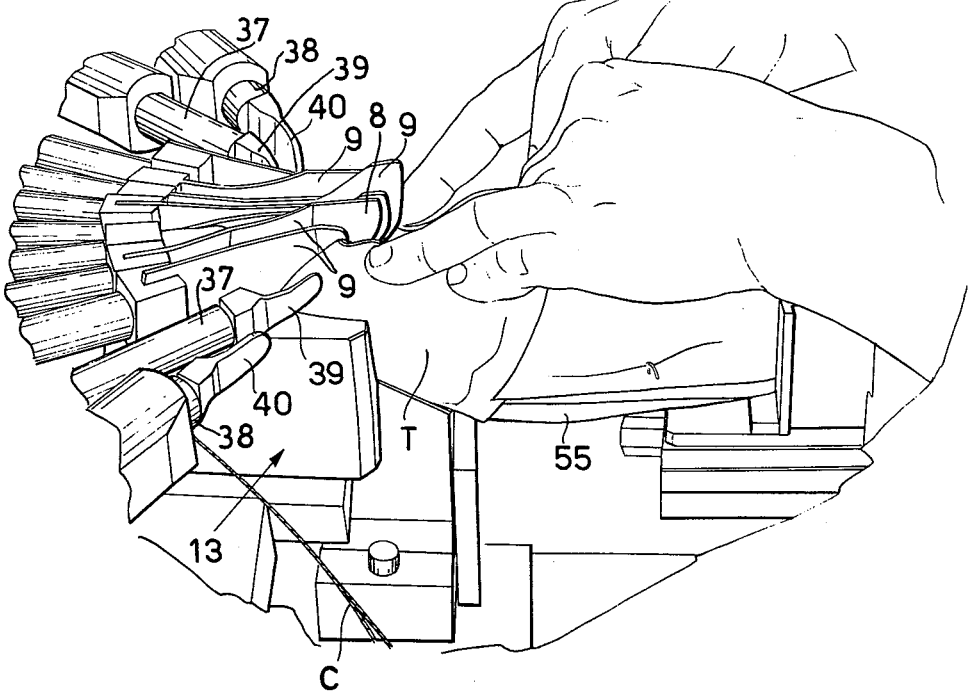

At this point the operator again manually raises the assembly 49 into the rest position of FIG. 2 (FIG. 10 shows an intermediate passage) and moves the mechanical fingers 37 of the two lateral groups 12 (FIG. 11) forward. The effect of this is to fold the lateral edges of the vamp over the last.

Figure 12:
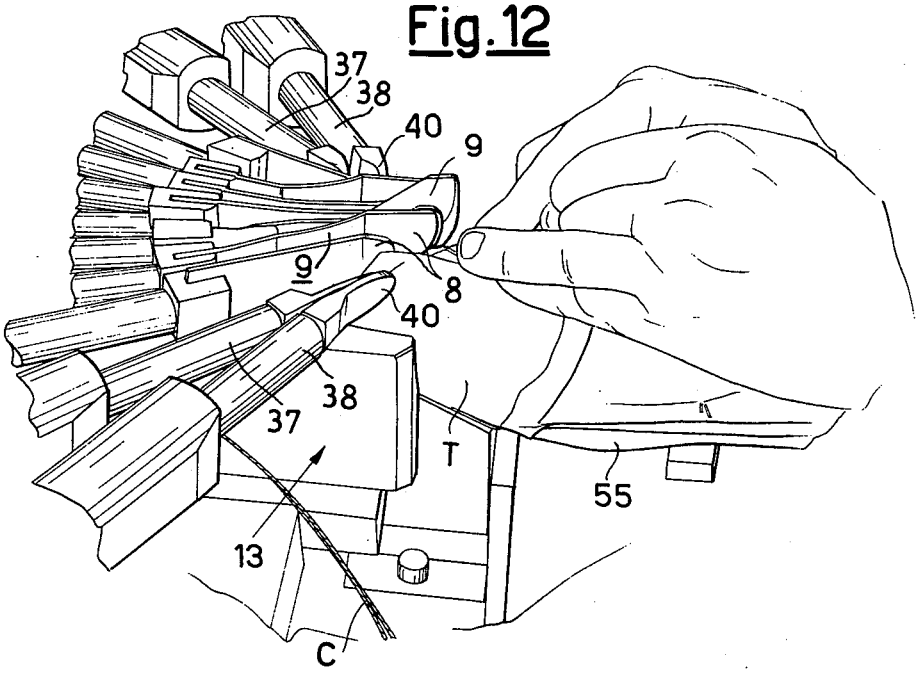
Figure 13:
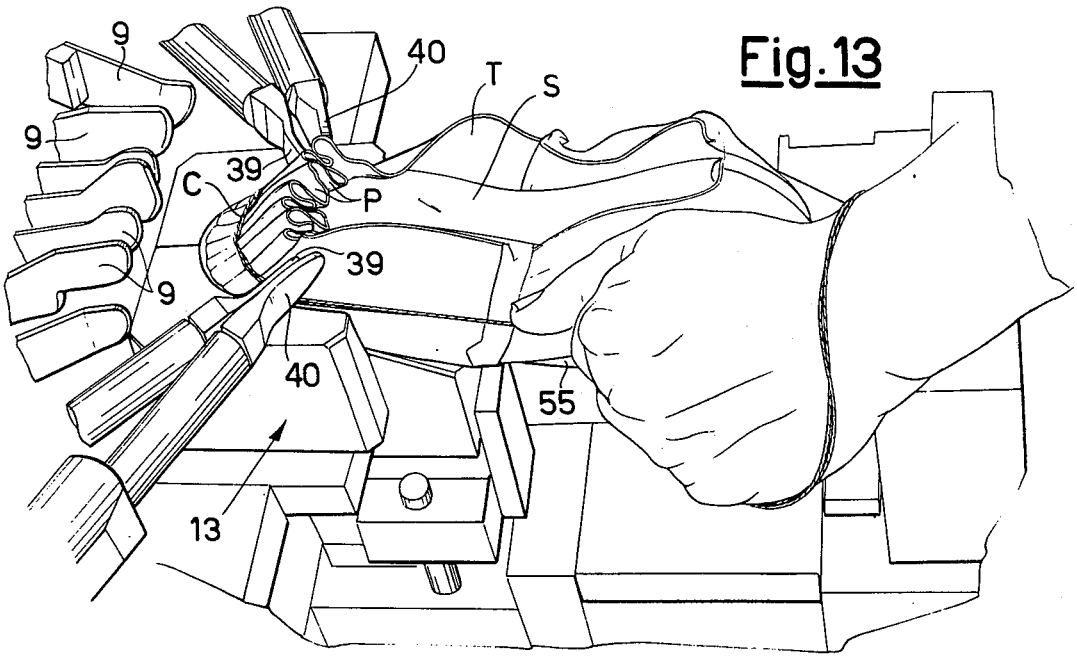

The mechanical fingers 38 of the lateral assemblies 12 are then moved forward into the position shown in FIG. 12 for the same purpose.

This folding of the lateral edges of the vamp at the toe may also be advantageously aided manually by the operator.

The operator now withdraws the mechanical finger assembly 11 (FIG. 13), and in the conventional manner using a piece of string C fixed to the last, stretches the folds P of the vamp, which are also preferably flattened with a manual tool, for example a hammer.

Figure 14:
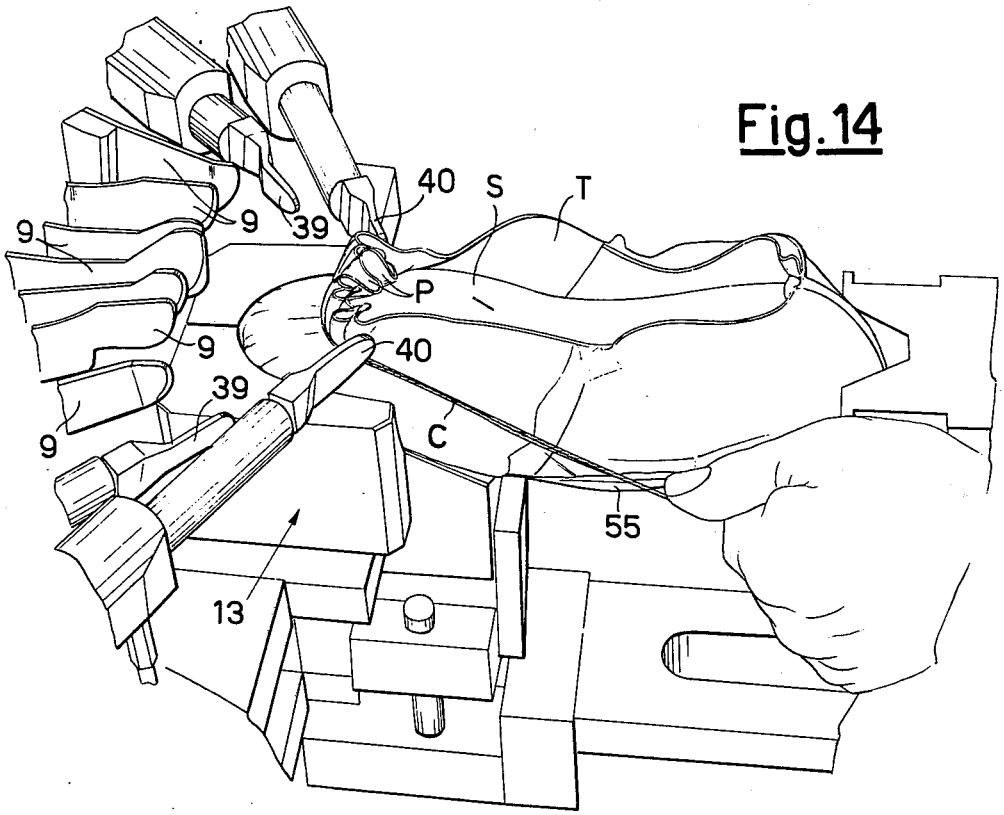
Figure 15:
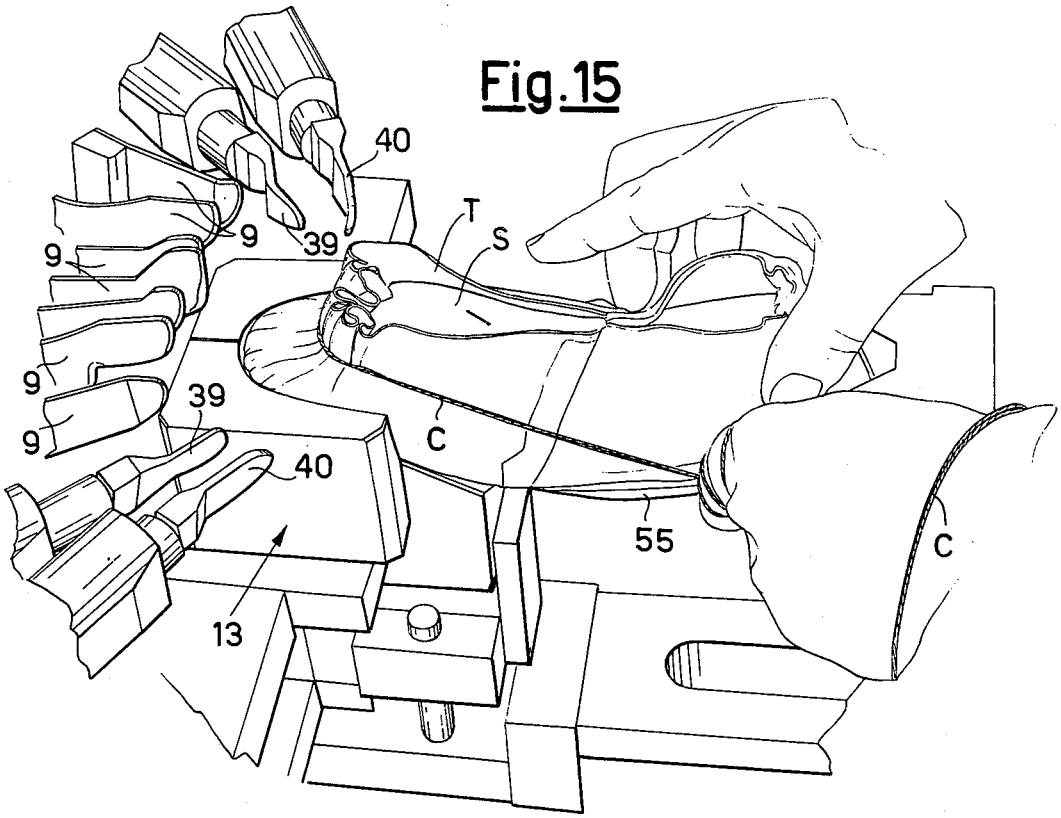
Figure 16:
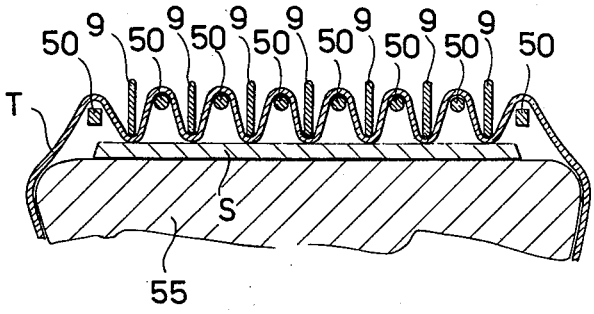
FIG. 16 is a detail.

The mechanical fingers 37 and then the mechanical fingers 38 are withdrawn in sequence, as shown in FIGS. 14, 15, and the last with the vamp suitably folded at its toe is ready for feeding to the subsequent processes.

The object of mechanising the laborious toe folding operations of shoes of the type mentioned in the introduction to this description is thus attained, with great advantage to economic production, both from the quantitative and qualitative aspects.

Although a preferred embodiment of the invention has been illustrated and described in detail, it will be apparent that variations and modifications may be made to it. For example, the movements of the working assembly 49 could be automated rather than manual, and the control systems for the mechanical fingers could be different.

The scope of the present invention is consequently defined by the following claims.

What we claim is:

1. An automatic toe forming machine for shoes, in particular dancing and gymnastics shoes, comprising, in combination, a last holding assembly, a first assembly of mechanical fingers movable between a non-working position and a working position in which they rest against the toe of a shoe on a last contained is said last holding assembly, a second assembly of mechanical fingers also movable between a non-working position and a working position in which they are disposed between the fingers of the first assembly so as to make the vamp covering the last assume a pattern in the form of folds, its path passing under the fingers of one assembly and over the fingers of the other, and a third and a fourth assembly of mechanical fingers to the sides of the second assembly mobile backwards and forwards laterally to the first mechanical finger assembly and cooperate with said second mechanical finger assembly.

2. A machine as claimed in claim 1, wherein said first mechanical finger assembly comprises parallel spaced-apart fingers fixed to one end of a first arm which is pivoted to a second angle arm which, in its turn, is pivoted to the machine frame, so that the fingers are movable between said non-working position in which they are raised above the last holding assembly, and said working position in which the fingers rest on said last.

3. A machine as claimed in claim 1, wherein said second mechanical finger assembly comprises one central finger and two sub-groups of lateral fingers, directional cams cooperating with said sub-groups of lateral fingers to bring the fingers of said second assembly into a position of exact insertion between the fingers of the first.

4. A machine as claimed in claim 1, wherein the fingers of said second assembly are substantially coplanar with the last disposed in said last holder.

5. A machine as claimed in claim 1, wherein the fingers of the second assembly each terminate in a blade portion.

6. A machine as claimed in claim 3, wherein the fingers of the second assembly are each formed from rods hinged together to swivel in two horizontal and vertical planes normal to each other.

7. A machine as claimed in claim 1, wherein said second mechanical finger assembly is connected to a curved support plate driven by hydraulic cylinders.

8. A machine as claimed in claim 1, wherein said third and fourth mechanical finger assemblies each comprise a pair of fingers movable one independently of the other.

9. A machine as claimed in claim 1, wherein the fingers of said third and fourth assemblies terminate in a blade portion.

10. A machine as claimed in claim 1, wherein the fingers of said third and fourth assemblies are coplanar with the last disposed in said last holder.

11. A machine as claimed in claim 1, wherein the fingers of said third and fourth assemblies are each formed from rods hinged together to swivel in two horizontal and vertical planes normal to each other.

* * * * *